US007284576B1

(12) United States Patent
Yacko et al.

(10) Patent No.: US 7,284,576 B1
(45) Date of Patent: Oct. 23, 2007

(54) APPARATUS FOR FILLING RECEIVING CONTAINERS

(75) Inventors: R. Bruce Yacko, Toledo, OH (US); Edward L. Mueller, Toledo, OH (US); John A. Wiegand, Sylvania, OH (US); Jeffrey C. Gayer, Sylvania, OH (US); Todd G. Schimmoeller, Ottawa, OH (US)

(73) Assignee: Jaws International Ltd., Toledo, OH (US)

( * ) Notice: Subject to any disclaimer, the term of this patent is extended or adjusted under 35 U.S.C. 154(b) by 0 days.

(21) Appl. No.: 11/289,024

(22) Filed: Nov. 29, 2005

Related U.S. Application Data

(63) Continuation-in-part of application No. 10/348,646, filed on Jan. 21, 2003, now Pat. No. 6,968,876.

(51) Int. Cl.
*B67D 1/12* (2006.01)

(52) U.S. Cl. ..... 141/95; 141/83; 141/102; 141/104; 141/359; 141/198; 222/129.3; 222/144.5

(58) Field of Classification Search ..... 141/94–96, 141/100, 351, 104, 198, 9, 83, 102, 105, 141/359; 222/129.1–129.4, 144.5
See application file for complete search history.

(56) References Cited

U.S. PATENT DOCUMENTS

| | | | | |
|---|---|---|---|---|
| 3,103,960 A | | 9/1963 | Simjian | |
| 4,559,979 A | * | 12/1985 | Koblasz et al. | 141/9 |
| 4,733,381 A | * | 3/1988 | Farmer et al. | 367/93 |
| 4,917,155 A | * | 4/1990 | Koblasz et al. | 141/1 |
| 4,929,818 A | | 5/1990 | Bradbury et al. | |
| 5,036,892 A | * | 8/1991 | Stembridge et al. | 141/1 |
| 5,040,699 A | | 8/1991 | Gangemi | |
| 5,203,387 A | | 4/1993 | Howlett et al. | |
| 5,566,732 A | | 10/1996 | Nelson | |
| 5,765,605 A | | 6/1998 | Waymire et al. | |
| 6,056,027 A | * | 5/2000 | Patterson | 141/370 |
| 6,082,419 A | * | 7/2000 | Skell et al. | 141/198 |
| 6,193,058 B1 | | 2/2001 | Yacko et al. | |
| 6,364,105 B1 | | 4/2002 | Yacko et al. | |
| 6,550,642 B2 | * | 4/2003 | Newman et al. | 222/39 |

(Continued)

FOREIGN PATENT DOCUMENTS

| | | |
|---|---|---|
| EP | 0725035 | 5/1998 |

(Continued)

OTHER PUBLICATIONS

International Search Report PCT/US2004/001541.

*Primary Examiner*—J. Casimer Jacyna
(74) *Attorney, Agent, or Firm*—MacMillan, Sobanski & Todd, LLC

(57) ABSTRACT

A container filling apparatus for topping off receiving containers that are partially filled with an initial amount of a solution of a concentrate and a diluent includes a dispenser for discharging additional concentrate into the receiving container, the dispenser being connected to a source of the concentrate. A controller is connected to the concentrate dispenser, the controller being programmed to determine the amount of the solution initially in the partially filled receiving container, and to discharge concentrate into the receiving container in an amount sufficient to provide a desired concentration of solution for a full receiving container of the solution.

20 Claims, 6 Drawing Sheets

U.S. PATENT DOCUMENTS

| | | | | |
|---|---|---|---|---|
| 6,578,763 | B1 | 6/2003 | Brown | |
| 6,772,944 | B2 | 8/2004 | Brown | |
| 6,789,585 | B1 * | 9/2004 | Janke | 141/198 |
| 2002/0030102 | A1 * | 3/2002 | Brown | 234/435 |
| 2003/0051767 | A1 | 3/2003 | Coccaro et al. | |
| 2005/0178799 | A1 * | 8/2005 | Cheong | 222/129.4 |

FOREIGN PATENT DOCUMENTS

| | | |
|---|---|---|
| WO | 02/42199 | 5/2002 |
| WO | 03/024814 | 3/2003 |
| WO | 03/086952 | 10/2003 |
| WO | 03/095354 | 11/2003 |

* cited by examiner

APPARATUS FOR FILLING RECEIVING CONTAINERS

RELATED APPLICATIONS

This application is a Continuation-In-Part application of U.S. patent application Ser. No. 10/348,646, filed Jan. 21, 2003, now U.S. Pat. No. 6,968,876 and entitled APPARATUS FOR DISPENSING A SUBSTANCE, all of which is incorporated in the present application in its entirety.

TECHNICAL FIELD

This invention relates to a system for efficiently dispensing substances such as liquids, solids or powders. More particularly, this invention pertains to a system for efficiently dispensing substances such as chemical solvents and cleaners, of that type that are advantageously or preferably controllably dispensed in measured doses.

BACKGROUND OF THE INVENTION

Industrial and commercial firms frequently require the use of industrial solutions, including cleaning solutions, disinfectant solutions and solvents for various purposes. In hospitals, for example, disinfectant solutions are often used on floors and other surfaces to assure a clean environment. Traditional technology for disbursing and handling these industrial solutions typically involves shipping the solution in bulk to the facility requiring the solution, and measuring out quantities of the solution for each use required. This system is disadvantageous in that it requires the shipping and storing of a large amount of bulky, heavy fluid. Alternatively, concentrated chemical sources can be shipped in smaller portions, but the end users are responsible for handling and diluting the chemicals, which are expensive, and, if handled improperly, could be dangerous.

Advances in the field of disbursing solutions have lead to the use of concentrates dispensed from a central location for dilution and use in various locations within an industrial or commercial facility. The concentrates can be either in a liquid or a solid form. The use of concentrates is an improvement over shipping fully diluted solutions, which require large storage units and take up valuable space in a hospital or factory, for example. In large industrial and commercial facilities concentrate dispensing systems are established to provide for filling and refilling of individual dispensing containers or receiving containers, such as refillable spray bottles. It would be advantageous is there could be developed better ways of filling the receiving containers.

SUMMARY OF THE INVENTION

This invention relates to a system for filling receiving containers. According to this invention there is provided a container filling apparatus for topping off receiving containers that are partially filled with an initial amount of a solution of a concentrate and a diluent. The apparatus includes a dispenser for discharging additional concentrate into the receiving container, the dispenser being connected to a source of the concentrate. A controller is connected to the concentrate dispenser, the controller being programmed to determine the amount of the solution initially in the partially filled receiving container, and to discharge concentrate into the receiving container in an amount sufficient to provide a desired concentration of solution for a full receiving container of the solution.

According to this invention there is also provided a container filling apparatus for topping off receiving containers that are partially filled with an initial amount of a solution of a chemical concentrate and a diluent. The apparatus includes a dispenser for discharging additional concentrate into the receiving container, the dispenser being connected to a source of the concentrate. A diluent supply mechanism is connected to a source of the diluent and is configured to deliver diluent to the receiving container. A controller is connected to the concentrate dispenser and the diluent supply mechanism, the controller being programmed to first substantially fill the initially partially full receiving container with diluent, and to measure the amount of diluent required to be added to the initially partially full receiving container to substantially fill the receiving container with diluent, and then to discharge concentrate into the receiving container to provide the desired concentration, with the amount of concentrate being discharged being determined in response to the measured amount of diluent added.

According to this invention there is also provided a container filling apparatus for topping off receiving containers that are partially filled with an initial amount of a solution of a concentrate and a diluent. The apparatus includes a dispenser for discharging additional concentrate into the receiving container, the dispenser being connected to a source of the concentrate. A diluent supply mechanism is connected to a source of the diluent and configured to deliver diluent to the receiving container. A controller is connected to the concentrate dispenser and the diluent supply mechanism. The controller is programmed to initially determine the amount of the solution in the partially filled receiving container, and to then measure the amount of diluent discharged from the diluent supply mechanism into the receiving container. The controller is further programmed to then discharge, in response to the amount of diluent discharged from the diluent supply mechanism, concentrate into the receiving container in an amount sufficient to provide a desired concentration of solution for a full receiving container of the solution.

According to this invention there is also provided a container filling apparatus for topping off receiving containers that are partially filled with an initial amount of a solution of a concentrate and a diluent. The apparatus includes a dispenser for discharging additional concentrate into the receiving container, the dispenser being connected to a source of the concentrate. A diluent supply mechanism is connected to a source of the diluent and configured to deliver diluent to the receiving container. The diluent supply mechanism includes a valve. A controller is connected to the concentrate dispenser and the valve of the diluent supply mechanism, the controller being programmed to initially determine the amount of the solution in the partially filled receiving container. The controller is further programmed to close the valve when a condition of an overflowing receiving container is sensed.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
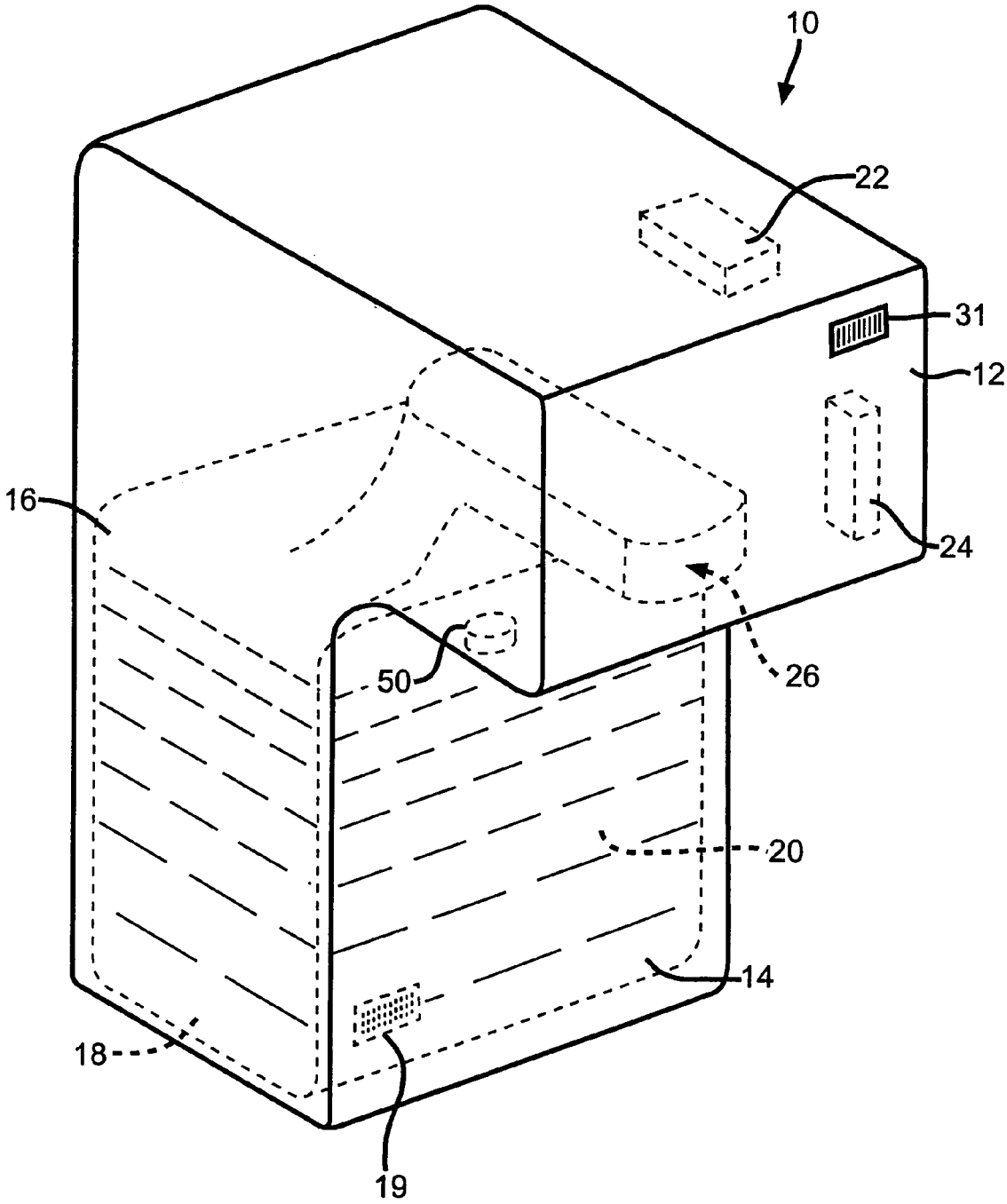
FIG. 1 is a perspective view of a source container dispensing apparatus for dispensing materials.

Referring now to the drawings there is illustrated in FIG. 1 a dispensing apparatus 10 for dispensing a substance. The dispensing apparatus 10 as illustrated has an inverted "L" shape, but the apparatus 10 can have any suitable shape or configuration. As shown, the body of the dispensing apparatus 10 has a generally rectangular upper portion 12 and lower portion 14. The lower portion 14 can act as a base and preferably has a cavity 16 formed therein such that a source container 18 can be positioned inside the apparatus 10. However, it should be understood that the source container 18 could be positioned at any suitable location within or without the apparatus 10. Additionally, the dispensing apparatus 10 could be adapted to have any size or shape. Therefore, the source container 18 could also have any size or shape, wherein the size or shape of the container 18 corresponds to or can be connected to the apparatus 10. Alternatively, the source container 18 could be smaller than the cavity 16 of the apparatus 10 so that multiple source containers 18 could be positioned therein. The source container 18 preferably contains a substance 20 that is to be dispensed from the dispensing apparatus 10. When the contents 20 of the source container 18 have been depleted, the apparatus 10 could be opened, and the source container 18 replaced or refilled. In a preferred embodiment, the source container 18 is a replaceable cartridge. The upper portion 12 of the dispensing apparatus 10 preferably has the capacity to receive a control device or controller 22, a reading mechanism 24 and a dispenser 26. The dispenser 26 of the apparatus, preferably located on the underside of the upper portion 12 of the dispensing apparatus 10, can include a nozzle, valve or tap (not shown). The dispenser 26 can be connected to the source container 18 in any manner such that when the dispenser 26 is activated, the dispenser 26 can discharge a substance 20 from the source container 18. Various appurtenances can also be attached to the body of the dispensing apparatus 10 such as a hose connected to the dispenser 26 or a mechanism to allow the apparatus 10 to be connected to receiving vessel, such as an a mop bucket 28, a maid/maintenance cart, not shown, an auto scrubber, not shown.

The control device or controller 22 of the dispensing apparatus 10 is preferably a microchip, a computer or any other controlling device that acts as a controller for the apparatus 10. The controller 22 operates a program that can be enabled to control how and when the apparatus 10 dispenses the substance 20 from the source container 18. It is preferred that the controller 22 be programmed such that the dispenser 26 can only be activated when the controller 22 allows the dispenser 26 to operate, regardless of whether an operator attempts to operate the dispenser 26. Therefore, it is preferred that the controller 22 be connected to the dispenser 26. It is also preferred that the controller 22 be connected to the reading mechanism 24, which can be an RF (radio-frequency) receiver, a bar code scanner, a magnetic strip reader, a fingerprint reader, a retinal scanner, or any other suitable reading mechanism that is capable of reading data on sources of data. Sources of data can include data indicators 19, 30, 31, which are preferably attached to the dispensing apparatus 10, the source container 18 and a receiving container 32, as shown in FIG. 3.

Figure 2:
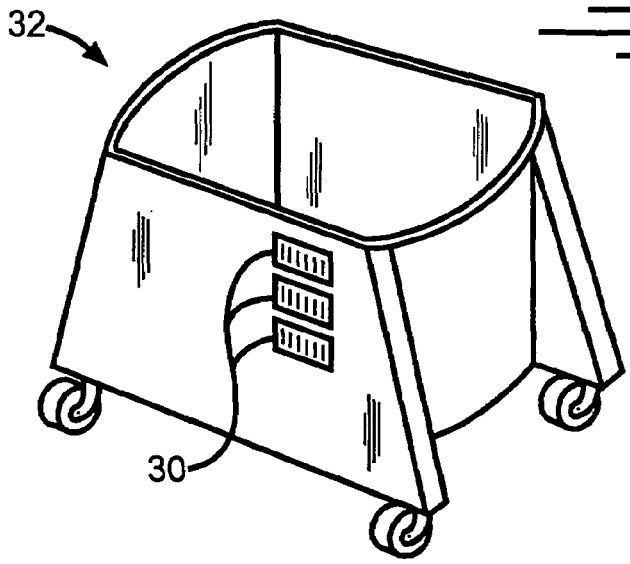
FIG. 2 is an enlarged perspective view of a first receiving container.

As illustrated in FIG. 2, the first example of a receiving container 32 is a conventional mop bucket. The bucket 32 can have any volume, shape or size, but it is preferred that the bucket 32 be appropriately sized such that a mop head or any other type of brush can be positioned inside the bucket 32 to gain access to the materials contained therein. Positioned on the bucket 32, preferably at a convenient location such as on the top of one of the sides or on at least one of the sides, is at least one data indicator 30 for providing information about the bucket 32. As described above, the dispensing apparatus 10 can be adapted to be mounted with the bucket 32 so that the substance 20 to be dispensed can be easily discharged into the receiving container 32.

Figure 3:
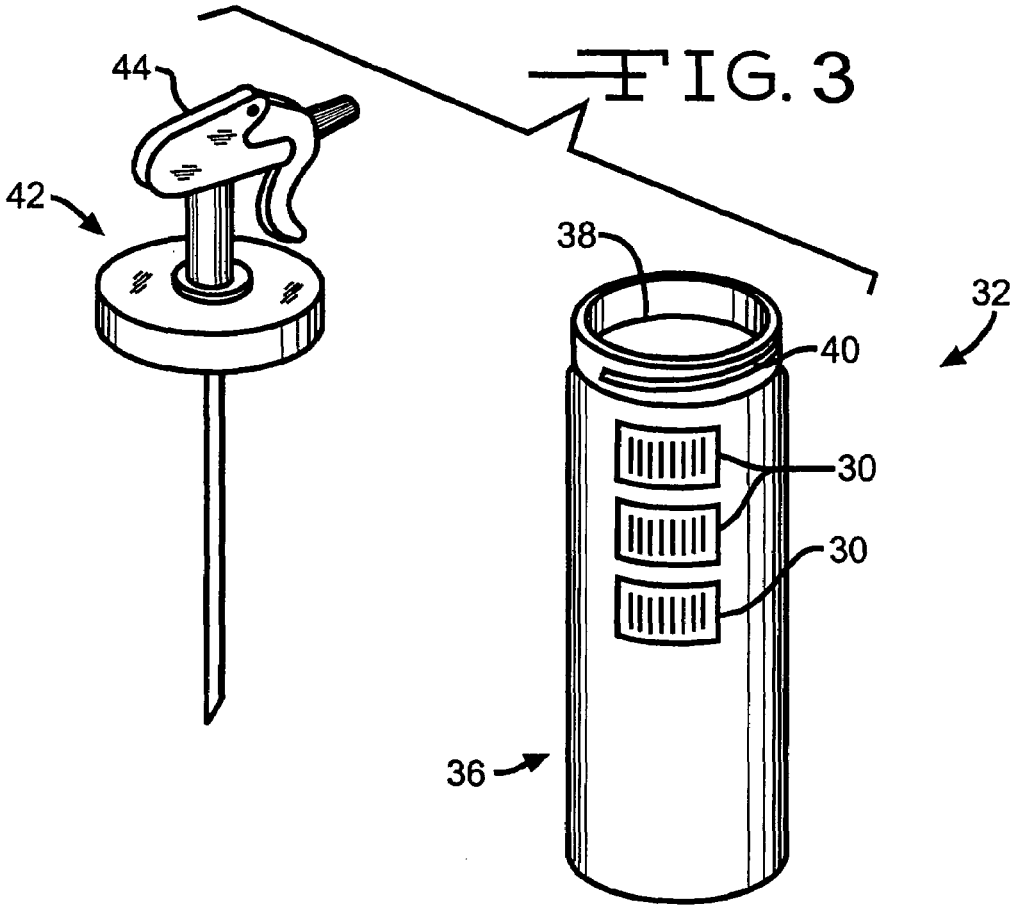
FIG. 3 is an enlarged perspective view of a second receiving container.

Shown in FIG. 3 is a second example of a receiving container in the form of a spray bottle 32 having a cylindrical body 36 with an opening 38 at the top end. The top end also preferably has threads 40 that mate with a corresponding cap 42. The threads 40 could also be used to position the bottle 32 with respect to the dispensing apparatus 10. The cap 42 preferably includes an apparatus that allows for easy discharge of the fluid from the bottle 32, such as a trigger sprayer 44. Positioned on the body 36 of the bottle 32, preferably at a convenient location, is at least one data indicator 30. Although two embodiments of receiving containers have been illustrated, it should be understood that any suitable receiving container could be used with the dispensing apparatus 10.

The reading mechanism or reader 24 is adapted to read the data indicators 30. Depending on the reading mechanism 24, the data indicator 19, 30 could be an RF chip (or transmitter), a bar code, a magnetic strip, or any other data indicator that corresponds to the type of reader 24 that is being used. The data contained on the data indicators 19, 30 preferably includes data about the source container 18 or receiving container 32. The source container data indicator 19 can contain data identifying the substance 20 contained within the source container 18, the amount of the substance 20 that is to be dispensed, the frequency with which the substance 20 can be dispensed, the operating personnel that are permitted to dispense the substance 20, or any other information about the substance 20 or accessibility to the substance. The amount of substance 20 to be dispensed can be based on the actual volume of substance 20 dispensed, on the amount of time the dispenser 26 remains open, or any other suitable measuring parameter. The receiving container data indicator 30 can contain data identifying the substance 20 (or substances) that the container 32 is capable of receiving, the amount of the substance 20 that is to be received, the frequency with which the receiving container 32 can receive the substance 20, who can fill the receiving container 32, or any other desired information about the receiving container 32.

Figure 4:
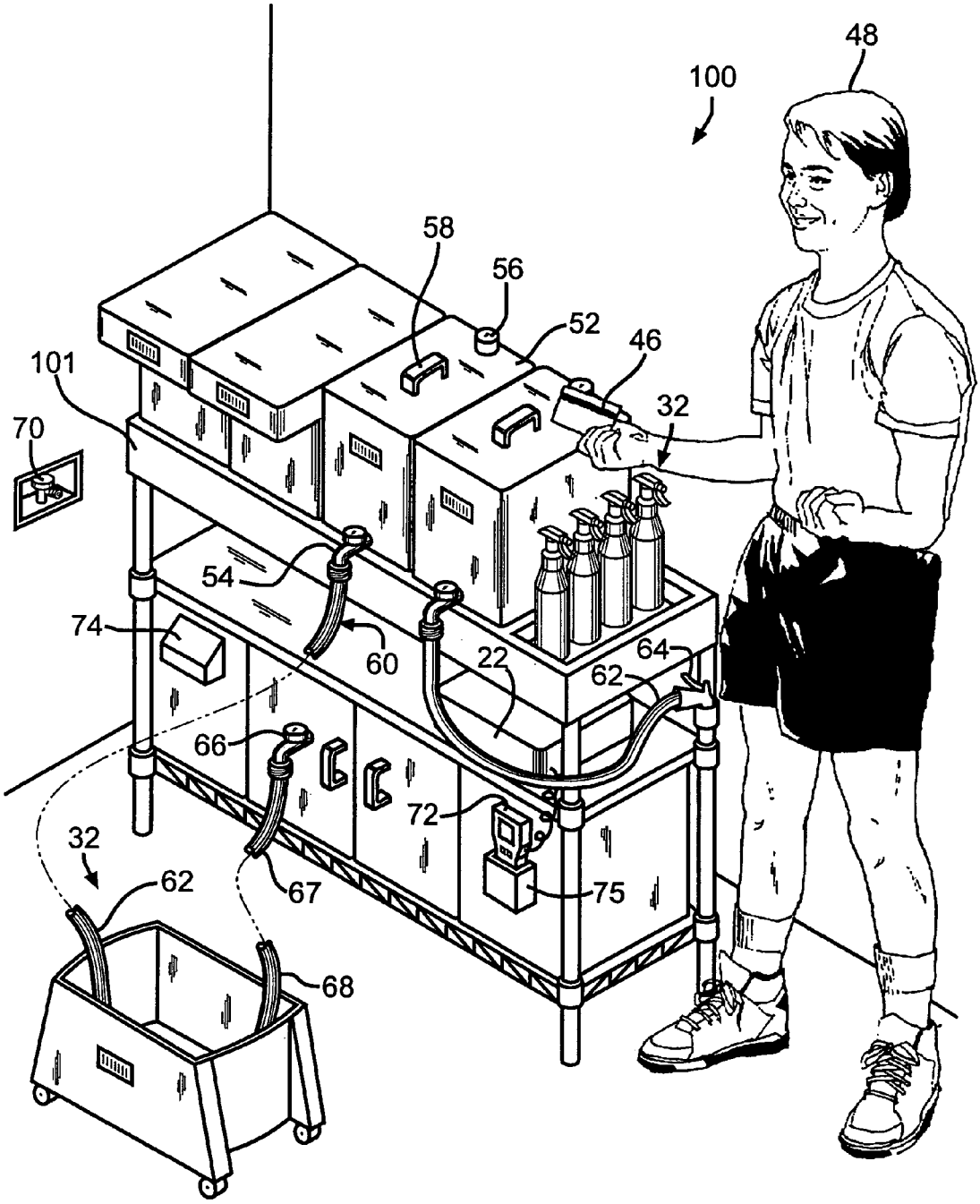
FIG. 4 is a perspective view of an alternate embodiment of a dispensing apparatus.

The controller 22 is preferably programmed such that when certain dispensing conditions are met, the controller 22 will allow the dispenser 26 to discharge an amount of the substance. The dispensing conditions are preferably based on the data is that is contained on the data indicators 19, 30. Particularly, the controller 22 could allow the dispenser 26 to activate when the receiving container data indicator 30 is read by the reading mechanism 24 and is a match to a pre-established condition. For example, an RF chip on the receiving container 32 would register with an RF reading mechanism on the apparatus 10 and indicate that the receiving container 32 is the correct container to receive the substance 20 contained in the apparatus 10 (and the source container 18). Alternatively, the receiving container data indicator 30 could be a bar code and the reading mechanism 24 could be a bar code scanner. If the bar code that is read by the scanner matches a code programmed within a database in the program of the controller 22, the controller 22 would allow the dispenser 26 to activate. Additionally, a data indicator 19 could be located on the source container 18 as well. The reading mechanism 24 could then be used to read both the source container data indicator 19 and the receiving container data indicator 30. If the control program detects that both the source data indicator 19 and receiving data indicator 30 correspond to each other the controller 22 would then allow the dispenser 26 to activate. Other dispensing conditions could include a data indicator match between the source 18 and receiving containers 32, and a match between the source or receiving container data indicators 19, 30 and a personnel identification indicator 46, as shown in FIG. 4 where the person 48 is illustrated holding the indicator 46. The personnel identification indicator 46 is a data indicator that contains information about the person 48 attempting to operate the apparatus 10. A plurality of data indicators 19, could be affixed to the source container 18 and receiving container 32 thereby allowing multiple substances 20 to be dispensed, respectively, from or into a container 18, 32. Although it has been described that the source data indicators 19 and the receiving data indicators 30 "match", it should be understood that the term "match" can include any type of correspondence which permits the program of the controller 22 to recognize that a dispensing condition is satisfied thus authorizing activation of the dispenser 26.

It is preferred that the controller be programmed to process the information from the data indicators 19, 30, 46 to determine whether the dispensing conditions are satisfied. Therefore, the control program can receive information from the reading mechanism 24, process the received data and determine whether to activate the dispenser 26 based on the data received. For example, based on data from the data indicators 19, 30, the control program can identify the amount of the substance 20 that is to be dispensed from the source container 18 and the amount of substance 20 to be received in the receiving container 32 and determine whether there is a match between the data indicators 19, 30. Additionally, the controller 22 can be programmed to record the amount of substance 20 discharged per operation of the dispenser 26, the number of receiving containers 32 processed, the frequency with which receiving containers 32 are filled, the operator 48 of the apparatus 10, and the time of day the apparatus 10 is accessed. To prevent theft or waste, the program of the controller 22 can also detect and record whether an operator 48 of the apparatus 10 attempted to dispense a substance 20 at a frequency that exceeds an allowable amount, into an unauthorized container, in a greater amount than permitted, whether an unauthorized operator attempted to use the apparatus 10, who operates the apparatus 10 and when it is operated. It can be appreciated that the controller 22 can be programmed to include a greater or lesser number of parameters, including any other suitable types of information desired to be detected and recorded by the users of the apparatus 10.

In an alternate embodiment, the apparatus 10 has a locating mechanism 50 that can determine whether the receiving container 32 is properly positioned with respect to the dispenser 26 or source container 18. This is to prevent the substance 20 from being dispensed while the receiving container 32 is not appropriately placed. The locating mechanism 50 can be a movable tab that authorizes or enables the dispenser 26 when displaced by the receiving container 32. In a preferred embodiment, the locating mechanism 50 is an optical or infrared scanner. It is further preferred that the locating mechanism 50 also be connected to the controller 22 so that the controller 22 can prevent the dispensing of the substance 20 if the scanner 50 sends a signal to the controller 22 indicating that the receiving container 32 is improperly positioned. Alternatively, the dispensing apparatus 10 can be adapted to lockingly receive the receiving container 32 by using a threaded attachment or snap-in mechanism. Then, the locating mechanism 50 could detect the position of the receiving container 32 and notify the controller 22 that a container 32 is in the proper position for dispensing. The controller 22 could then check the data indicator 30 to ensure that the receiving container 32 is the proper one and that any other dispensing condition is also satisfied prior to activating the dispenser 26 to dispense the substance 20. In an alternate embodiment, the dispensing apparatus 10 could include a combination of the sensors described above and have an actuator such that when the data and position indicators verify that a data and position match has occurred, the operator of the apparatus 10 can depress a button to trigger the apparatus 10 to dispense the substance 20.

Illustrated in FIG. 4 is an alternate embodiment having a dispensing station, indicated generally at 100. The dispensing station 100 includes a dispensing apparatus 10 as described above, and preferably a plurality of dispensing apparatuses. However, each source container 18 could act directly to dispense a substance 20. For example, a source container could be a generally hollow container 52, such as a tank, having an independent outlet 54 or dispenser. Each container 52 could be filled with a liquid, solid or powder material. The dispenser 54 could include any type of release mechanism such as a spigot, valve, faucet, tap, or nozzle. The source container tanks 52 could optionally have an inlet 56 in order to allow for refilling of the container 52. Preferably, the containers 52 are made of a generally clear material so that the quantity of the substance 20 remaining therein is easily discernable by observing the outside of the container 52. Additionally, the source containers 52 are preferably sized to have a multi-gallon capacity. However, the containers 52 can have any size or shape and can be made of any material. The source container tanks 52 can also optionally have handles 58, multiple outlets or inlets, feet or any other appurtenances suitable for use with source containers. Any other suitable source containers, such as jugs, bags or lined boxes may also be used. Attached to each outlet 54 of the source container 52 could be a spigot or a flexible hose 60 such that one end of the hose 60 is connected to the outlet or spigot 54 and the other, dispensing end 62 is adapted to be positioned in or above a receiving container 32. At the dispensing end of the hose 62, there can optionally be a dispenser such as a trigger sprayer 64, tap or nozzle. Alternatively, each source container 18, 52 can dispense directly into a receiving container 32 from the spigot or outlet 54.

The receiving containers 32 can contain water or another diluent prior to receiving the substance. However, pre-filled containers are not required; a diluent can be added to the receiving container 32 after the container receives the substance 20. The receiving container 32 carrying a solution of the substance 20 and diluent can then be used at any location such as a different room, floor, or building as needed. Alternatively, a diluent could be connected to the source container 52 such that upon activation of the dispenser 54, the diluent mixes with the discharge of the source container 52 prior to being dispensed into the receiving container 32. The mixing could be done in a separate chamber or in the hose connecting the source container 52, diluent source 66 and the receiving container 32. Additionally, a plurality of source containers 18, 52 could be connected to a mixing chamber and mix a plurality of substances 20 (including a diluent) prior to discharging a mixture of substances into the receiving container 32.

The source containers 18, 52 are preferably positioned at a dispensing station 100. The dispensing station 100 preferably includes a cart 101 that is optionally mounted on wheels. This would allow the station 100 to be positioned at a central location or moved as needed. In an alternate embodiment, the station 100 can be a permanent, unmovable structure. The source containers 18, 52 can be loosely positioned on or securely fastened to the cart 101 such that they can be refilled, removed, or replaced as needed. The station 100 can also include a hose 67 that is attachable to a diluent source 66 on one end with a nozzle attached to a dispensing end 68. The diluent source can be a permanent source, such as a wall outlet 70, water tap or sink, or a movable source, such as diluent tank 66 supplied on the station 100 or a loose tank (not shown). The dispensing end 68 of the diluent hose 67 is preferably is adapted to dispense water or another diluent into the receiving container 32 with ease and efficiency.

Figure 5:
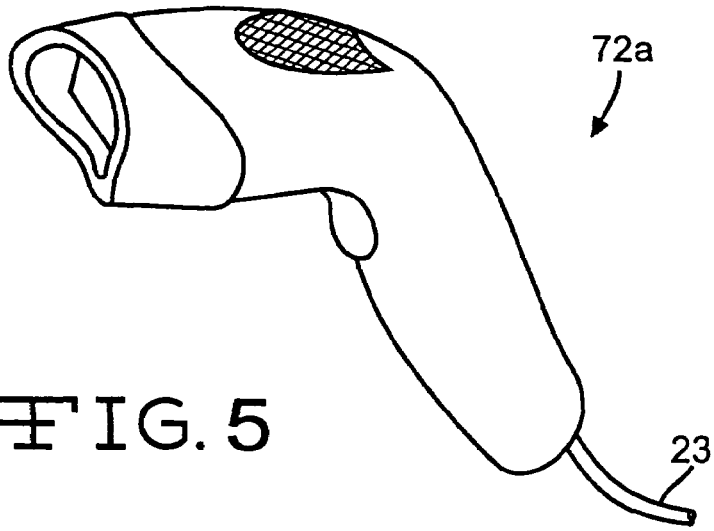
FIG. 5 is an enlarged view of a first handheld reading device.
Figure 6:
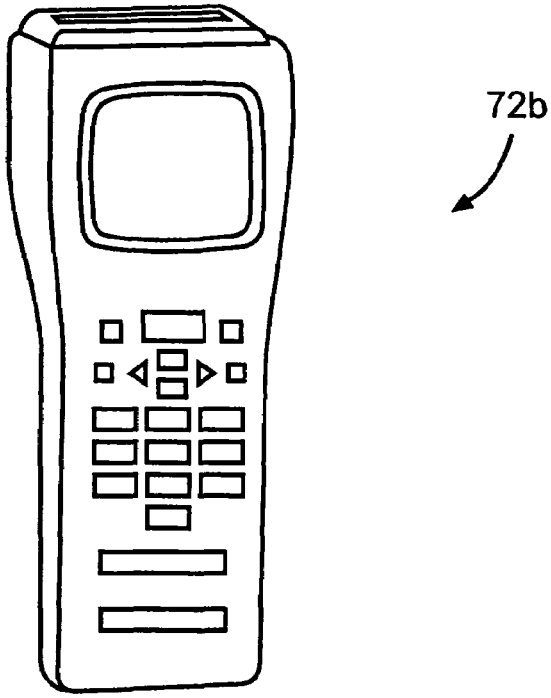
FIG. 6 is an enlarged view of a second handheld reading device.

For safety and cost reasons, it is preferred that only a specified amount of the substance 20 be dispensed into a particular receiving container 32. As described above, the operation of the dispensing apparatus 10, 54 can be managed by programming a controller 22 to process data from the data indicators 19, 30. The data indicators 19, 30 on the receiving container 32 and source container 18, 52 can be a magnetic strip, bar code, colored tag, pre-printed instruction label, or any other identifying indicia. It is preferred that the data indicator 19, 30 be a magnetic strip, bar code or RF system so that a controller 22 operating a data matching and tracking program can determine when and whether a substance 20 is dispensed and thus, removes any potential user confusion. Therefore, it is also preferred that the dispensing station 100 have a reading mechanism 72, 74 such as a magnetic strip reader or scanner device so that the information on the data indicators 19, 30 can be transmitted to the controller 22. The reader 74 can be permanently affixed to the cart as shown in FIG. 4. The receiving container 32 can then be moved to the reader 74 in order to be read. It is preferred that the reader 72 be movable relative to the cart 101. This would allow the reader 72 to be moved toward the item to be read, and thus would be easier to handle by the user. Movable readers 72, such as those shown in FIGS. 5 and 6, are shown as conventional scanning devices. Any suitable scanning/reading device can be used. The handheld reader 72*a* shown in FIG. 5 is preferably adapted to be physically connected to a controller 22 by a cable 23. Many reading devices come with a cable 23 that allows data to be transferred from the reading device 72 to a controller 22. Alternatively, the reading device 72*b* can be wireless, such as the device shown in FIG. 6. If the wireless reading device 72*b* is used, there is preferably a stand or holster 75 of some sort that retains the device 72*b* with the station. Alternatively, a portable reader 72 could be connected to a receiving container 32 such that the reader 72 travels with the receiving container 32.

The controller 22 is preferably attached to the cart 101 of the station 100 and adapted to process the data read by the reader 72, 74 to determine whether a dispensing process should commence. The controller 22 can be programmed similarly to the controller 22 described with respect to the other embodiments. This can prevent a user 48 from siphoning off or pilfering the substance 20, which in many cases can be very expensive. Therefore, in any of the embodiments described herein, the station 100 or dispensing apparatus 10 can be equipped with an alarm (not shown) so that the person 48 using the station 100 or apparatus 10 and others know when an attempt is made to dispense the substance 20 at a frequency faster than a preset rate. An alarm can also be set for attempts to fill an improper receiving container 32, to dispense from a source container 18 to a non-matched receiving container 32, to dispense a greater than authorized amount of the substance 20, to indicate a lack of pre-filling of the receiving container 32 with diluent, and to operate the apparatus 10 or station 100 in violation of the control program. The controller can be programmed to disable the dispenser to prevent dispensing of the substance when the alarm is sounded. The controller 22 should also be adapted to store in a memory device the data read by the reading mechanism 22, 72, 74. The memory device could be made integrally with the controller 22. The information collected by the controller 22 can be downloaded or transmitted to a central computer or master control device for the purpose of inventory control, use information, ordering information, and quality control. The data is preferably stored in the controller 22 using random access memory, read only memory, or on a transferable or portable memory device such as a CD-ROM, flash-ROM chip, floppy disk, or any other suitable computer memory device (not shown). Alternatively, the controller 22 can transmit the data from a stored medium to another computer, master control device or memory storage device via a modem, a plug-in connection to a portable controller, a radio transmitter and receiver system, infrared means (such as via a PALM® operated device or a similar handheld computing device), or any other means. Additionally, the controller 22 could operate as the master control device allowing direct printing or downloading of information from the controller 22.

In a further preferred embodiment, the controller 22 operates a control program that is enabled to determine whether an individual 48 attempting to use the apparatus 10 or station 100 is authorized to do so. This is to prevent theft or misuse of a substance 20 contained in a source container 18 by an untrained individual or a person who should not be accessing the substance. Such a program can be implemented to read a personnel data indicator 46, such as a bar code or magnetic strip, on an individual's nametag, uniform, or personnel identification card 46. Alternatively, more sophisticated systems, such as fingerprint or retinal scanning, can also be used. The reading device for identifying purposes can be the same as the reader 24, 72, 74 for the source container data indicator 19 and receiving container data indicator 30, but a different reader could also be used. It is preferred that the personnel identification reading mechanism be connected to the controller 22 such that the controller 22 can record and track which personnel used the station 100 or apparatus 10, when the station 100 or apparatus 10 was used, and whether an attempt was made to use the station or apparatus improperly. As described above, an alarm (using lights and sound) can be used to indicate to the user 48 and others if someone attempts to access the station 100 or apparatus 10 without authorization or attempts to use it incorrectly.

Although the apparatus has been described as dispensing a generic substance 20, it is preferred that the apparatus be used for dispensing chemical concentrates or any other liquid into any type of receiving container. The method and apparatus described here are particularly adapted for the dispensing of concentrated cleaning chemicals into a diluent-filled dispensing bottle. The method and apparatus of the described here can be used to dispense many other substances including ketchup, soda, and fruit juices as well as non-food substances. Also, the dispensing apparatus could dispense a powder such as hot chocolate powder, instant coffee and lemonade powder. Additionally, the dispensing mechanism 26 could be adapted to dispense any type of substance, including solids and powders, such as prescription pills, pesticides or any other material where measured dispensing is advantageous.

Figure 7:
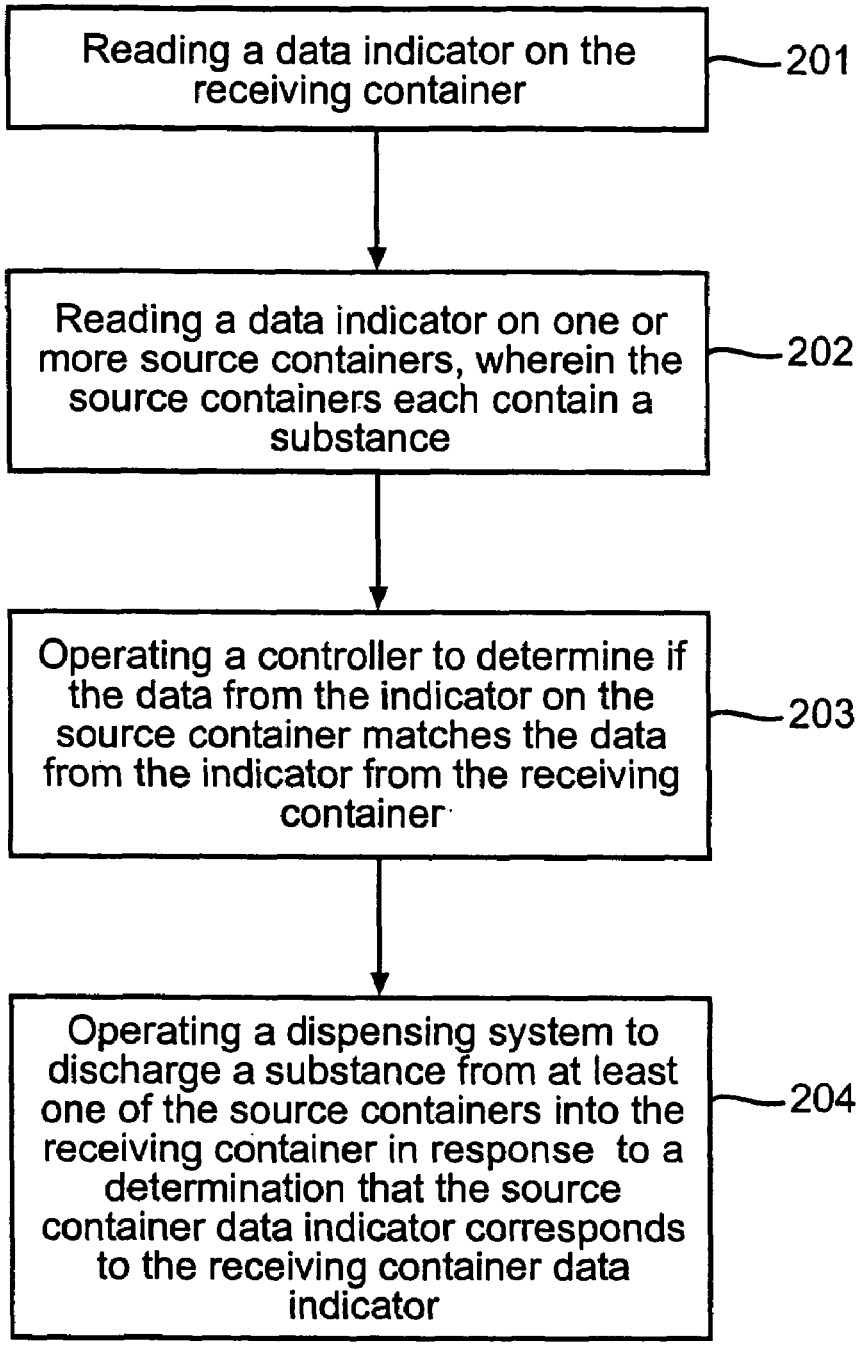
FIG. 7 is a process diagram of the steps used in a the method of operating the apparatus.

Shown in FIG. 7 is a flow chart depicting the method of operating a dispensing apparatus. The method of dispensing a substance into a receiving container includes: in a first step 201 (a) reading a data indicator on the receiving container; in a second step 202 (b) reading a data indicator on one or more source containers, wherein the source containers each contain a substance; in a third step 203 (c) operating a controller to determine if the data from the indicator on the source container matches the data from the indicator from the receiving container; and in a fourth step 204 (d) operating a dispensing system to discharge a substance from at least one of the source containers into the receiving container in response to a determination that the source container data indicator corresponds to the receiving container data indicator. The controller is programmed to determine when a dispensing condition is satisfied, based on the data from the receiving container, and to generate a signal when the dispensing condition is satisfied. The dispenser is configured to discharge the substance into the receiving container in response to the signal from the controller.

The method can optionally include, individually or jointly, the steps of: (e) operating the controller to dispense an amount of the substance based on data contained on the data indicator; (f) operating the controller to record the amount of the substance discharged, the number of receiving containers filled, the frequency with which receiving containers are filled, and the number of discharges made from the source container; (g) operating the controller to record at least one of the total amount of the substance discharged and the amount of the substance discharged per operation of the dispensing system; (h) operating the controller to limit the frequency with which receiving containers can be filled; (i) operating the controller to communicate the recorded data to a master control device; and (j) operating a mechanism for personnel identification such that the dispensing system is operable only when the system recognizes the personnel as being authorized.

Figure 8:
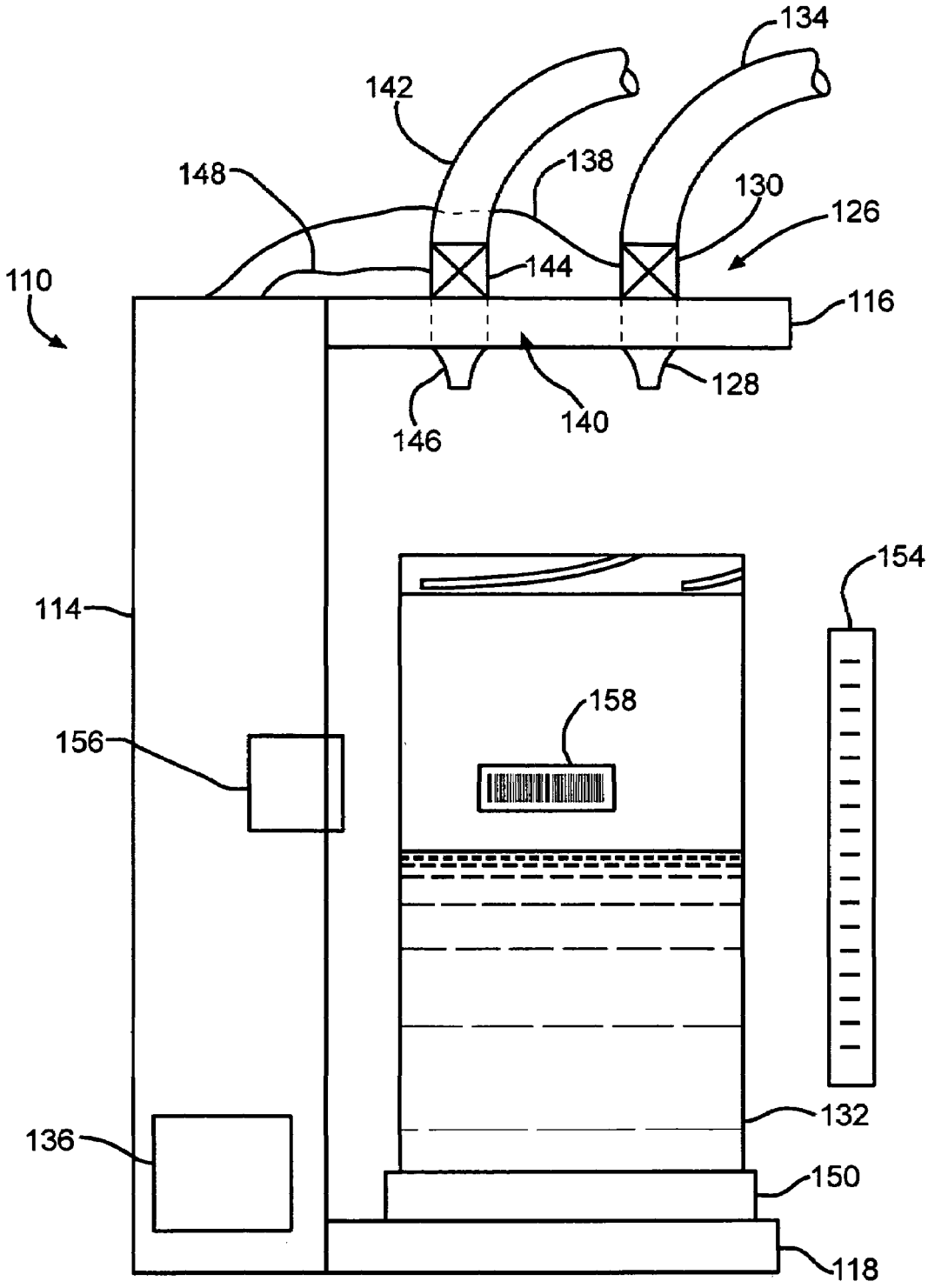
FIG. 8 is a schematic view in elevation of a container filling apparatus capable of topping off receiving containers.

In another aspect of the dispensing apparatus, shown in FIG. 8, there is provided a container filling system or apparatus 110 for topping off receiving containers 132 that are partially filled with an initial amount of a previously formulated solution of a concentrate and a diluent. It can be seen that the receiving container 132 is initially partially filled. The apparatus 110 includes a housing 114 having an upper section 116 and a base 118. The upper section 116 includes a dispenser 126 for discharging additional concentrate into the receiving container 132. The dispenser 126 includes a nozzle 128 and a valve 130. The concentrate dispenser 126 is connected to a source of concentrate, not shown, by means of a concentrate tube 134. Operation of the valve 130 opens the valve to discharge additional concentrate into the initially partially filled receiving container 132.

The housing 114 of the apparatus 110 includes a controller 136 configured operate the apparatus 110. The controller 136 is connected to the source of the concentrate by means of the concentrate dispenser 126. More specifically, the controller 136 is connected to the concentrate dispenser 126 by hard wire 138. Other types of connections, such as wireless connections, could also be used. The controller 136 is programmed to determine the amount of the solution initially in the partially filled receiving container 132, and to discharge concentrate into the receiving container 132 in an amount sufficient to provide a desired concentration of solution for a full receiving container of the solution.

In a specific embodiment of the invention, the apparatus 110 includes an optional diluent supply mechanism 140. The diluent supply mechanism 140 is connected to a source of the diluent, not shown, via diluent tube 142, and is configured to deliver diluent to the receiving container 132. Operation of a valve 144 opens the valve to discharge diluent via a nozzle 146 into the initially partially filled receiving container 132. The controller 136 is connected to the diluent supply mechanism 140 by any suitable means, such as hard wire 148. The controller 136 is programmed to discharge diluent via the diluent supply mechanism 140 into the receiving container 132 in an amount sufficient to substantially fill the receiving container. The determination of when the receiving container 132 becomes substantially full can be made by a full container level sensor, not shown, or by visual inspection, or by any other suitable means.

The diluent supply mechanism 140 is optional with respect to the broadest aspect of the invention because it is possible for the diluent to be added by hand from any source of diluent, and not added by means of the apparatus 110 for topping off receiving containers. Also, optionally, the valve 144 can be operated manually.

In one embodiment, the controller 136 is programmed to first substantially fill the initially partially full receiving container 132 with diluent, and then discharge concentrate into the receiving container to provide the desired concentration for the solution in the receiving container 132. The diluent can be added by having an operator open valve 144 until the receiving container is substantially full. Alternatively, the system can be provided with an automatic diluent filling mechanism, not shown, that fills the bottle with diluent in the amount sufficient to substantially fill the bottle.

In order for the controller to signal the concentrate dispenser 126 to discharge the proper amount of concentrate, the apparatus must be able to determine how much of the solution is initially in the receiving container 132 prior to topping off. Several methods can be used to determine the amount of the solution initially in the partially filled receiving container 132. One method is to measure the amount of diluent required to be added to the initially partially full receiving container 132 to substantially fill the receiving container with diluent. This measurement can be by volume or by weight. The actual measurement of the amount of diluent added to the partially filled receiving container 132 by volume can be made by the flow valve 144, which can be configured to measure flow, or by any other suitable flow measuring device.

The actual measurement of the amount of diluent added to the partially filled receiving container 132 by weight can be made by using a weight sensor, such as the scale 150 on the base 118. The scale 150 is connected to the controller 136 and the controller can determine the amount of diluent added, i.e., the weight of the added diluent, by comparing the weight of the receiving container 132 before and after the delivery of the additional diluent to the receiving container.

While the controller can be programmed to first discharge diluent into the receiving container to substantially fill the receiving container 132, and then discharge concentrate into the receiving container to provide the desired concentration, the order can be reversed, with the controller programmed to first discharge concentrate into the receiving container to provide the desired concentration, and then substantially fill the initially partially full receiving container with diluent.

The apparatus 110 can be provided with a level sensor, shown schematically at 154, to sense or determine the level of the solution in the initially partially filled receiving container 132. The level sensor can be any suitable level sensor, several of which are known in the art. The controller 136 can be programmed to determine the amount of solution initially in the partially filled receiving container by means of the level sensor 154, and use this level of the solution in the partially filled receiving container 132 to determine the amount of concentrate necessary to achieve the desired concentration of the solution in the ultimately full receiving container.

The container filling apparatus 110 can be provided with a reading mechanism, such as an RF receiver indicated at 156, capable of reading data from a data indicator, such as RF chip 158, on the receiving container. The data indicator (RF chip) identifies data about the receiving container, and more particularly can identify the size of the container. The controller 136 can use this data as one factor in calculating the amount of concentrate necessary to discharge into the receiving container 132 to provide the desired concentration of solution in the receiving container when it gets filled up or topped off. Any suitable reading mechanism and any suitable data indicator can be used.

It is to be understood that the concentrate can be a particulate solid, such as a powder, or a liquid, such as a chemical concentrate. For example, the concentrate can be a concentrated cleaning detergent. The apparatus 110 can be used in combination with one or more receiving containers to reliably and repeatedly top off the receiving containers, such as, for example, spray bottles of cleaning solution. It is to be understood that the apparatus 110 can be configured to mix diluent with the concentrate, and to discharge this mixture into the receiving container, rather than discharging the concentrate and diluent separately into the receiving container 132.

In a specific embodiment, the controller is programmed to then discharge, in response to the amount of diluent discharged from the diluent supply mechanism, concentrate into the receiving container in an amount sufficient to provide a desired concentration of solution for a full receiving container of the solution. Further, the controller can be further programmed to close the valve when a condition of an overflowing receiving container is sensed. The sensing of an overflow condition can be detected in any suitable manner, such as by means of a weight sensor configured to determine the amount of liquid in the receiving container, or by means of a volume sensor configured to determine the amount of liquid in the receiving container.

The principle and mode of operation of this invention have been described in its preferred embodiments. However, it should be noted that this invention may be practiced otherwise than as specifically illustrated and described without departing from its scope.

What is claimed is:

1. A container filling apparatus for topping off receiving containers that are partially filled with an initial amount of a solution of a concentrate and a diluent, the apparatus comprising:

a dispenser for discharging additional concentrate into the receiving container, the dispenser being connected to a source of the concentrate;

a level sensor configured to determine a level of the solution in the partially filled receiving container; and a controller connected to the concentrate dispenser, the controller being programmed to:

use the level of the solution to determine the amount of the solution initially in the partially filled receiving container, and to determine an amount of concentrate to discharge into the receiving container sufficient to provide a desired concentration of solution for a full receiving container of the solution, and discharge the determined amount of concentrate into the receiving container.

2. The apparatus of claim 1 in which a diluent supply mechanism is connected to a source of the diluent and is configured to deliver diluent to the receiving container, in which the controller is connected to the diluent supply mechanism, and in which the controller is programmed to discharge diluent via the diluent supply mechanism into the receiving container in an amount sufficient to substantially fill the receiving container.

3. The apparatus of claim 2 in which the controller is programmed to first substantially fill the initially partially full receiving container with diluent, and then discharge concentrate into the receiving container to provide the desired concentration, and in which the step of determining the amount of the solution initially in the partially filled receiving container is accomplished by measuring the amount of diluent required to be added to the initially partially full receiving container to substantially fill the receiving container with diluent.

4. The apparatus of claim 3 in which the measuring of the amount of diluent added is accomplished by measuring the volume of diluent added.

5. The apparatus of claim 3 in which the measuring of the amount of diluent added is accomplished by measuring the weight of diluent added.

6. The apparatus of claim 2 in which the controller is programmed to first discharge concentrate into the receiving container to provide the desired concentration, and then substantially fill the initially partially full receiving container with diluent.

7. The apparatus of claim 1 in which the controller is programmed to determine the amount of solution initially in the partially filled receiving container by means of a level sensor, with the level sensor being configured to determine the amount of the solution in the partially filled receiving container.

8. The apparatus of claim 1 in which the controller is programmed to determine the amount of solution in the partially filled receiving container by means of a weight sensor configured to determine the amount of the solution in the partially filled receiving container.

9. The apparatus of claim 1 including a reading mechanism capable of reading data from a data indicator on the receiving container, wherein the data indicator identifies data about the receiving container.

10. The apparatus of claim 9 wherein the data indicator on the receiving containers includes data on the size of the receiving container, and wherein the reading mechanism is configured to determine the size of the receiving container by reading the data indicator, and further wherein the controller is programmed to use the size of the receiving container as one factor in determining the amount of concentrate to discharge into the receiving container to provide the desired concentration of solution for a full receiving container of the solution.

11. The apparatus of claim 1 in combination with a concentrate that is one of a liquid, a powder, and a particulate solid.

12. The apparatus of claim 1 in combination with a concentrate that is a chemical concentrate.

13. The apparatus of claim 1 further being adapted to mix diluent with the concentrate and discharge the mixture into the receiving container.

14. A container filling apparatus for topping off receiving containers that are partially filled with an initial amount of a solution of a chemical concentrate and a diluent, the apparatus comprising:

a dispenser for discharging additional concentrate into the receiving container, the dispenser being connected to a source of the concentrate;

a diluent supply mechanism that is connected to a source of the diluent and is configured to deliver diluent to the receiving container;

a level sensor configured to determine a level of the solution in the partially filled receiving container;

a controller connected to the concentrate dispenser and the diluent supply mechanism, the controller being programmed to:

first use the level of the solution to measure the amount of diluent required to be added to the initially partially full receiving container to substantially fill the initially partially full receiving container with diluent, add the amount of diluent required to substantially fill the receiving containers, and discharge concentrate into the receiving container to provide the desired concentration, with the amount of concentrate being discharged being determined in response to the measured amount of diluent added.

15. The apparatus of claim 14 in which the measuring of the amount of diluent added is accomplished by measuring the volume of diluent added.

16. The apparatus of claim 14 including a reading mechanism capable of reading data from a data indicator on the receiving container, wherein the data indicator identifies the size of the receiving container by reading the data indicator, and further wherein the controller uses the size of the receiving container as one factor in determining the amount of concentrate to discharge into the receiving container to provide the desired concentration of solution for a full receiving container of the solution.

17. A container filling apparatus for topping off receiving containers that are partially filled with an initial amount of a solution of a concentrate and a diluent, the apparatus comprising:

a dispenser for discharging additional concentrate into the receiving container, the dispenser being connected to a source of the concentrate;

a diluent supply mechanism connected to a source of the diluent and configured to deliver diluent to the receiving container;

a level sensor configured to determine a level of the solution in the partially filled receiving container; and a controller connected to the concentrate dispenser and the diluent supply mechanism, the controller being programmed to use the level of the solution to initially determine the amount of the solution in the partially filled receiving container, and to then measure and discharge the amount of diluent from the diluent supply mechanism into the receiving container, and the controller further being programmed to then discharge, in response to the amount of diluent discharged from the diluent supply mechanism, concentrate into the receiving container in an amount sufficient to provide a desired concentration of solution for a full receiving container of the solution.

18. A container filling apparatus for topping off receiving containers that are partially filled with an initial amount of a solution of a concentrate and a diluent, the apparatus comprising:

a dispenser for discharging additional concentrate into the receiving container, the dispenser being connected to a source of the concentrate;

a diluent supply mechanism connected to a source of the diluent and configured to deliver diluent to the receiving container, the diluent supply mechanism including a valve;

a level sensor configured to determine a level of the solution in the partially filled receiving container; and a controller connected to the concentrate dispenser and the valve of the diluent supply mechanism, the controller being programmed to use the level of the solution to initially determine the amount of the solution in the partially filled receiving container, and the controller being programmed to discharge concentrate into the receiving container in an amount sufficient to provide a desired concentration of solution, and the controller being further programmed to close the valve when a condition of an overflowing receiving container is sensed.

19. The container filling apparatus of claim 18 in which the controller is programmed to close the valve when a condition of an overflowing receiving container is sensed by means of a weight sensor configured to determine the amount of liquid in the receiving container.

20. The container filling apparatus of claim 18 in which the controller is programmed to close the valve when a condition of an overflowing receiving container is sensed by means of a volume sensor configured to determine the amount of liquid in the receiving container.

* * * * *